US005821948A

United States Patent [19]

Kawamoto et al.

[11] Patent Number: 5,821,948

[45] Date of Patent: Oct. 13, 1998

[54] IMAGE PROCESSING CIRCUIT AND DISPLAY UNIT HAVING THE IMAGE PROCESSING CIRCUIT

[75] Inventors: Yasuhisa Kawamoto, Inagi; Takeshi Murakami; Suzuki Ryuichi, both of Kawasaki, all of Japan

[73] Assignee: Fujitsu Limited, Kawasaki, Japan

[21] Appl. No.: 289,589

[22] Filed: Aug. 15, 1994

[30] Foreign Application Priority Data

Nov. 5, 1993 [JP] Japan ..... 5-276382

[51] Int. Cl.[6] ..... G09G 5/00

[52] U.S. Cl. ..... 345/507; 345/197; 345/212

[58] Field of Search ..... 345/153, 155, 345/197, 213, 507, 515, 513, 516, 212, 211, 508

[56] References Cited

U.S. PATENT DOCUMENTS 4,876,663 10/1989 McCord ..... 345/197
4,888,582 12/1989 Schnarel ..... 345/155
4,906,985 3/1990 Furlong ..... 345/197
5,313,231 5/1994 Yin et al. ..... 345/155
5,432,905 7/1995 Hsieh et al. .

*Primary Examiner*—Xiao Wu
*Attorney, Agent, or Firm*—Staas & Halsey

[57] ABSTRACT

An image processing circuit includes input terminals receiving image data as a first number of bits, a memory selectively storing the image data received at the input terminals and outputting the image data stored therein as a second number of bits, which is an integer multiple of the first number of bits, in response to a write signal which is synchronized to a memory clock signal, and a shift register selectively and in succession storing the image data output from the memory and outputting the image data stored therein as a third number of bits in response to a video clock signal which has a second frequency which is different from the first frequency of the memory clock signal and wherein the second number of bits is greater than the third number of bits.

17 Claims, 8 Drawing Sheets

IMAGE PROCESSING CIRCUIT AND DISPLAY UNIT HAVING THE IMAGE PROCESSING CIRCUIT

BACKGROUND OF THE INVENTION

The present invention generally relates to image processing circuits and display units and, more particularly, to an image processing circuit that processes image data to be displayed on a display of a computer and to a display unit which uses such an image processing circuit and is capable of displaying a multicolor image with a high resolution.

Recently, it has become possible to display natural color images resembling photographs on a display unit of a computer. Now, there are demands to display the multicolor images with a higher resolution.

FIG. 1 shows the construction of a conceivable multicolor image display unit. A multicolor image display unit 2 shown in FIG. 1 includes an integrated circuit device for display (hereinafter simply referred to as display LSI) 3, a video clock generator 4, a video memory 5, and a digital-to-analog converter (DAC) part 6. The DAC part 6 includes DACs 6-1, 6-2 and 6-3.

The display LSI 3 includes a video memory controller 8, a display controller 9, and a shift register 10 for display. This display LSI 3 is formed as a semiconductor chip, and carries out operations such as controlling transfers of image data from the video memory 5 to the DAC part 6 and generating a synchronizing signal SYNC with respect to a display (not shown).

The video clock generator 4 generates a video clock signal VCLK, and supplies this video clock signal VCLK to the display LSI 3 and the DAC part 6.

The video memory 5 stores image data, and a bus width at the output side of this video memory 5 is 96 bits, for example. In other words, when reading the image data from the video memory 5, 96 bits of parallel image data are read in synchronism with a read clock signal from the video memory controller 8.

The DAC part 6 is made up of the DACs 6-1, 6-2 and 6-3 which are respectively provided in correspondence with the red (R), green (G) and blue (B) input terminals of the display. Each of the DACs 6-1, 6-2 and 6-3 convert the digital image data transferred from the shift register 10 into analog data. The analog data are transferred to the display and displayed thereon. In this case, the DAC part 6 receives the 24-bit digital image data from the shift register 10, and 8 bits of the 24-bit digital data are supplied to each of the DACs 6-1, 6-2 and 6-3.

The video memory controller 8 controls the reading of the image data from the video memory 5 based on a data request signal from the display controller 9. The display controller 9 carries out various kinds of display control operations, and also generates the synchronizing signal SYNC which is supplied to the display.

The shift register 10 temporarily stores the image data transferred from the video memory 5, and reads the stored image data so as to make a data conversion from parallel data into serial data. In this case, a bus width at the input side of the shift register 10 is 96 bits, and a bus width at the output side of the shift register 10 is 24 bits.

According to the multicolor image display unit shown in FIG. 1, the read clock signal supplied to the video memory 5 and the synchronizing signal (dot clock signal) SYNC supplied to the display are synchronized to each other. In addition, the 24-bit image data is output from the display LSI 3, so that it is possible to display 16,777,216 colors.

The bus width of the video memory 5 is 96 bits, and the output of the video memory 5 is input to the shift register 10 and converted into the 24-bit image data.

In this case, when the video memory controller 8 receives the data request signal from the display controller 9, the video memory controller 8 outputs the read clock signal so that the image data are read from the video memory 5. The image data read from the video memory 5 are transferred to and stored in the shift register 10.

Thereafter, the image data stored in the shift register 10 are read out under the control of the display controller 9 and converted into the 24-bit image data. The 24-bit image data are input to the DAC part 6 in units of 8 bits, that is, each of the DACs 6-1, 6-2 and 6-3 receive 8 bits of the 24-bit image data. The 24-bit image data are thus converted into the analog image data by the DAC part 6 and transferred to the display.

The display displays the analog image data received from the DAC part 6 based on the synchronizing signal SYNC received from the display controller 9.

For example, the numerical examples of elements of the multicolor image display unit are as follows.

1) Image data bit width: 24 bits=3 bytes
2) Clock signal frequency for image display: 80 MHz
3) Necessary image data transfer rate: 240 Mbytes/sec
4) Maximum read frequency of video memory: 30 MHz
5) Read frequency of video memory (an integral ratio to the clock signal frequency for image display and a frequency not exceeding the maximum read frequency of the video memory): 20 MHz
6) Necessary bus width of video memory: 96 bits=12 bytes However, the following problems exist in the conceivable multicolor image display unit described above.

First, the clock signal supplied to the display LSI 3 is a single video clock signal VCLK. For this reason, it is necessary to operate the video memory controller 8 and the display controller 9 using the same video clock signal VCLK.

However, since the video clock signal VCLK is generated from the video clock signal generator 4 to suit the operations of the display controller 9, the shift register 10 and the DAC part 6, it is impossible to bring out the maximum performance of the video memory 5.

For example, in the case described above, the maximum read frequency of the video memory 5 is 30 MHz, but the actual read frequency of the video memory 5 is 20 MHz. Hence, it is impossible to efficiently bring out the read performance of the video memory 5.

Second, the read clock signal supplied to the video memory 5 is low in frequency, compared to the frequency of the read clock signal which is necessary to bring out the maximum performance of the video memory 5. Accordingly, the bus width at the output side of the video memory 5 becomes large; this bus width is 96 bits in the case described above.

Third, the number of terminals (pins) of the display LSI 3 becomes large for the reasons described above. As a result, the cost of the display LSI 3 and the related parts of the multicolor image display unit increases.

SUMMARY OF THE INVENTION

Accordingly, it is a general object of the present invention to provide a novel and useful image processing circuit and display unit, in which the problems described above are eliminated.

Another and more specific object of the present invention is to provide an image processing circuit comprising input terminals receiving image data in a first number of bits, memory means, coupled to the input terminals, for storing and outputting the image data from the input terminals in a second number of bits which is an integral multiple of the first number of bits in response to a write signal which is synchronized to a memory clock signal, and shift register means, coupled to the memory means, for successively storing and outputting the image data from the memory means in a third number of bits in response to a video clock signal which has a frequency different from that of the memory clock signal, where the first number of bits is smaller than the second number of bits, and the second number of bits is greater than the third number of bits. According to the image processing circuit of the present invention, it is possible to bring out the maximum read performance of the video memory. In addition, it is possible to reduce the bus width of the video memory and accordingly reduce the number of terminals required by the image processing circuit. As a result, it is possible to reduce the cost of the image processing circuit particularly when the image processing circuit is produced in the form of an integrated circuit chip.

Still another object of the present invention is to provide a display unit comprising a video memory storing image data, a digital-to-analog converter part converting the image data transferred from the video memory into analog image data, an integrated circuit device controlling transfer of the image data from the video memory to the digital-to-analog converter part, a display displaying an image described by the analog image data from the digital-to-analog converter part, a video clock generator generating a video clock signal used for controlling display of the image data, and a memory clock generator generating a memory clock signal having a frequency different from the video clock signal, where the image data are read from the video memory under the control of the integrated circuit device in synchronism with the memory clock signal. According to the display unit of the present invention, it is possible to bring out the maximum read performance of the video memory. In addition, it is possible to reduce the bus width of the video memory and accordingly reduce the number of terminals required by the integrated circuit device. As a result, it is possible to reduce the cost of the display unit.

Other objects and further features of the present invention will be apparent from the following detailed description when read in conjunction with the accompanying drawings.

DESCRIPTION OF THE PREFERRED EMBODIMENTS

Figure 1:
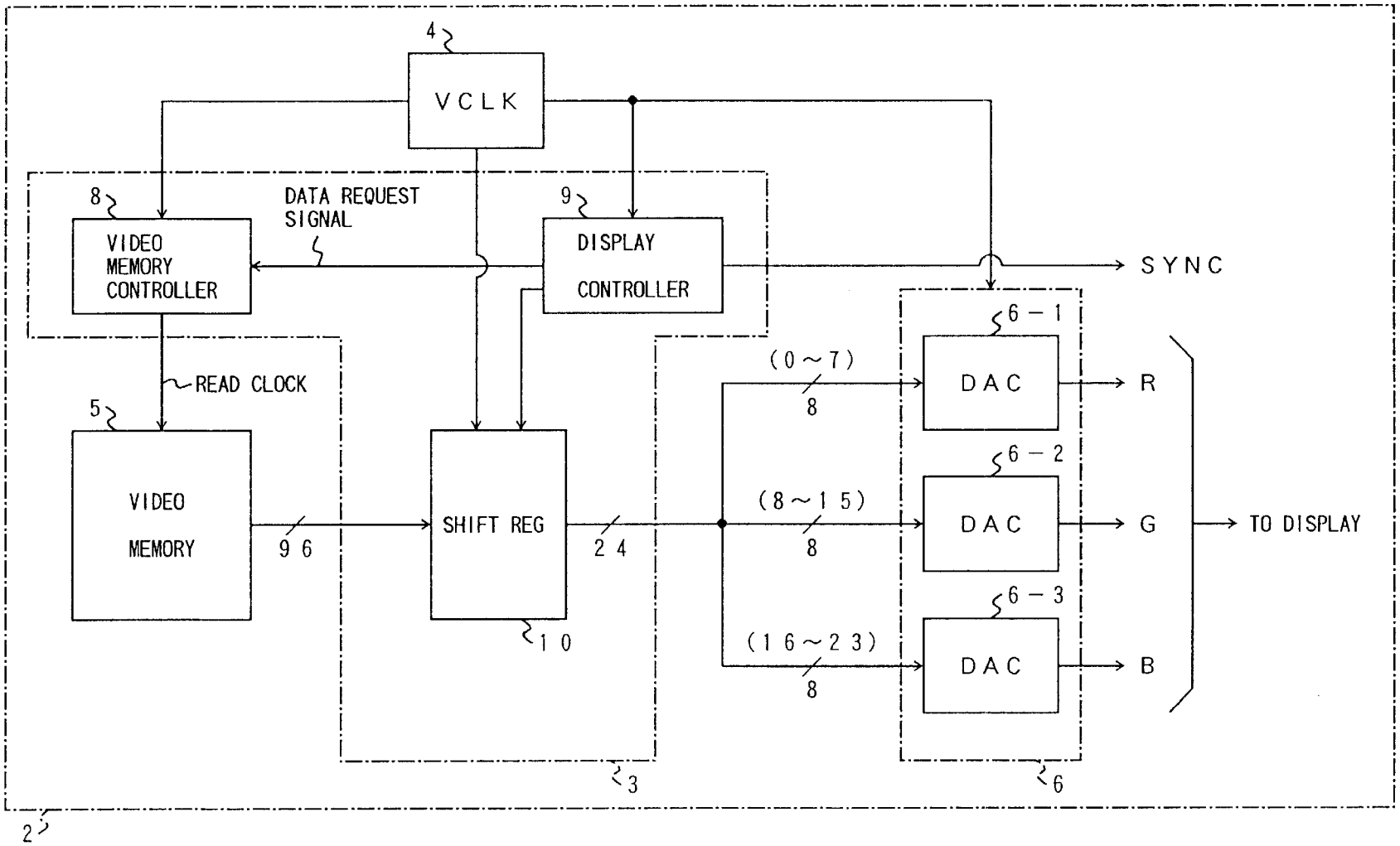
FIG. 1 is a system block diagram showing the construction of a conceivable multicolor image display unit.
Figure 2:
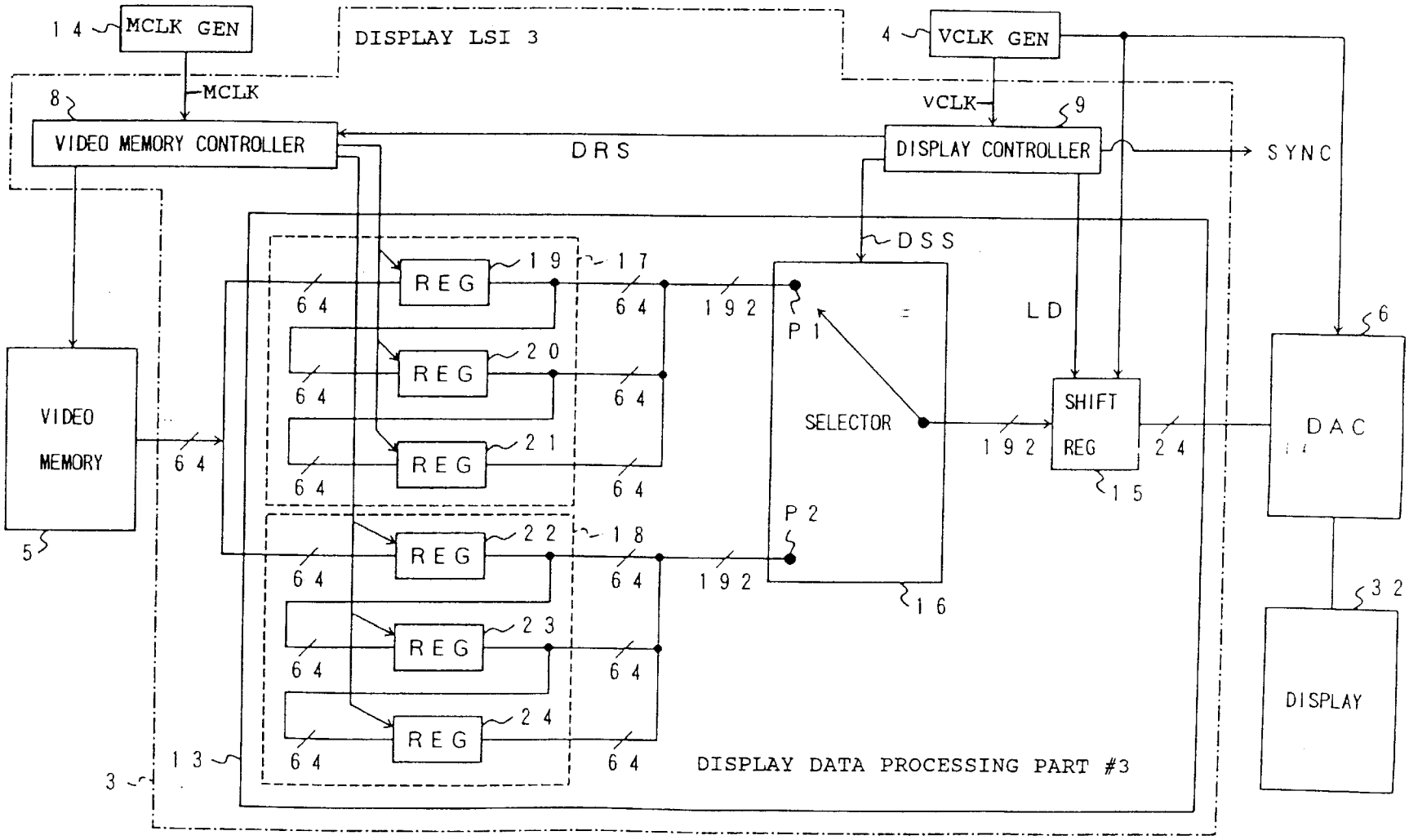
FIG. 2 is a system block diagram for explaining the operating principle of the present invention.

First, a description will be given of the operating principle of the present invention, by referring to FIG. 2. In FIG. 2, those parts which are the same as those corresponding parts in FIG. 1 are designated by the same reference numerals, and a description thereof will be omitted.

A multicolor image display unit shown in FIG. 2 generally includes a video clock generator (VCLK GEN) 4, a memory clock generator (MCLK GEN) 14, a video memory 5, a display LSI 3, a DAC part 6, and a display 32. The display LSI 3 includes a video memory controller 8, a display controller 9, and a display data processing part 13. This display data processing part 13 includes a shift register 15, a selector 16, and register parts 17 and 18 functioning as a memory and in which data conversion is performed in synchronism with the memory clock signal MCLK, as later described. The register part 17 is made up of registers 19, 20 and 21, and the register part 18 is made up of registers 22, 23 and 24.

The video memory 5 stores image data, and the DAC part 6 converts the image data transferred from the video memory 5 into analog data. The display LSI 3 controls the transfer of the image data from the video memory 5 to the DAC part 6. The display 32 displays the analog data output from the DAC part 6. The video clock generator 4 generates a video clock signal VCLK for image display. In addition, the memory clock generator 14 generates a memory clock signal MCLK which has a frequency different from (that is, higher than) the video clock signal VCLK and is asynchronous to the video clock signal VCLK. The reading of the image data from the video memory 5 under the control of the display LSI 3 is carried out in synchronism with the memory clock signal MCLK.

For example, the register parts 17 and 18 carry out a data conversion by successively shifting and storing the image data read from the video memory 5. By alternately switching and controlling the register parts 17 and 18 in synchronism with the memory clock signal MCLK, the data conversion can be made by alternately storing the image data read from the video memory 5 into the register parts 17 and 18.

In addition, the selector 16 alternately selects the output of the register part 17 and the output of the register part 18, so that the image data selected by the selector 16 are subjected to a data conversion and transferred to the DAC part 6.

In the present invention, the video memory controller 8 and the display controller 9 are operated in response to different clock signals, that is, the memory clock signal MCLK and the video clock signal VCLK, in order to bring out the maximum performance of the video memory 5. However, merely using the different clock signals would generate a problem in that the input data may change when the shift register 15 inputs the image data. In other words, the input data may not be settled (or stabilized) and may undergo a transition when the shift register 15 inputs the image data.

Hence, the image data read from the video memory 5 are once (i.e., initially) stored in the register parts 17 and 18. Thereafter, the stored image data are subjected to the data conversion and transferred to the shift register 15.

By taking this measure, it is possible to prevent the transition of the input data when the shift register inputs the image data.

More particularly, when a data request signal is output from the display controller 9 with respect to the video memory controller 8, the video memory controller 8 supplies a memory address and a read clock signal to the video memory 5 so as to read the image data from the video memory 5.

In addition, the video memory controller 8 alternately supplies a write signal "0" and a write signal "1" to the register part 17 and the register part 18, so that the image data transferred from the video memory 5 are alternately stored in the register parts 17 and 18.

Thereafter, the display controller 9 supplies a data selection signal to the selector 16. The selector 16 selects the output of the register part 17 or the output of the register part 18, and outputs the image data from one of the register parts 17 and 18 at one time. The selectively output image data from the selector 16 are transferred to the shift register 15.

The image data transferred from the selector 16 are once stored in the shift register 15 in response to a load signal output from the display controller 9. Then, the stored image data are read from the shift register 15 and subjected to a data conversion from 192 bits to 24 bits, and are transferred to the DAC part 6.

The DAC part 6 converts the image data (digital data) into analog data, and transfers the analog data to the display 32. As a result, an image corresponding to the analog data is displayed on the display 32.

Therefore, the present invention can efficiently bring out the read performance of the video memory 5, and also reduce the bus width of the video memory 5. For this reason, it is possible to reduce the number of terminals (pins) of the display LSI 3, and reduce the cost of the multicolor image display unit.

Next, a description will be given of a first embodiment of the multicolor image display unit according to the present invention, by referring to FIGS. 3 through 7. In FIGS. 3 through 7, those parts which are the same as those corresponding parts in FIGS. 1 and 2 are designated by the same reference numerals. This embodiment of the multicolor image display unit uses an embodiment of an image processing circuit according to the present invention. A display LSI 3 corresponds to the image processing circuit.

Figure 3:
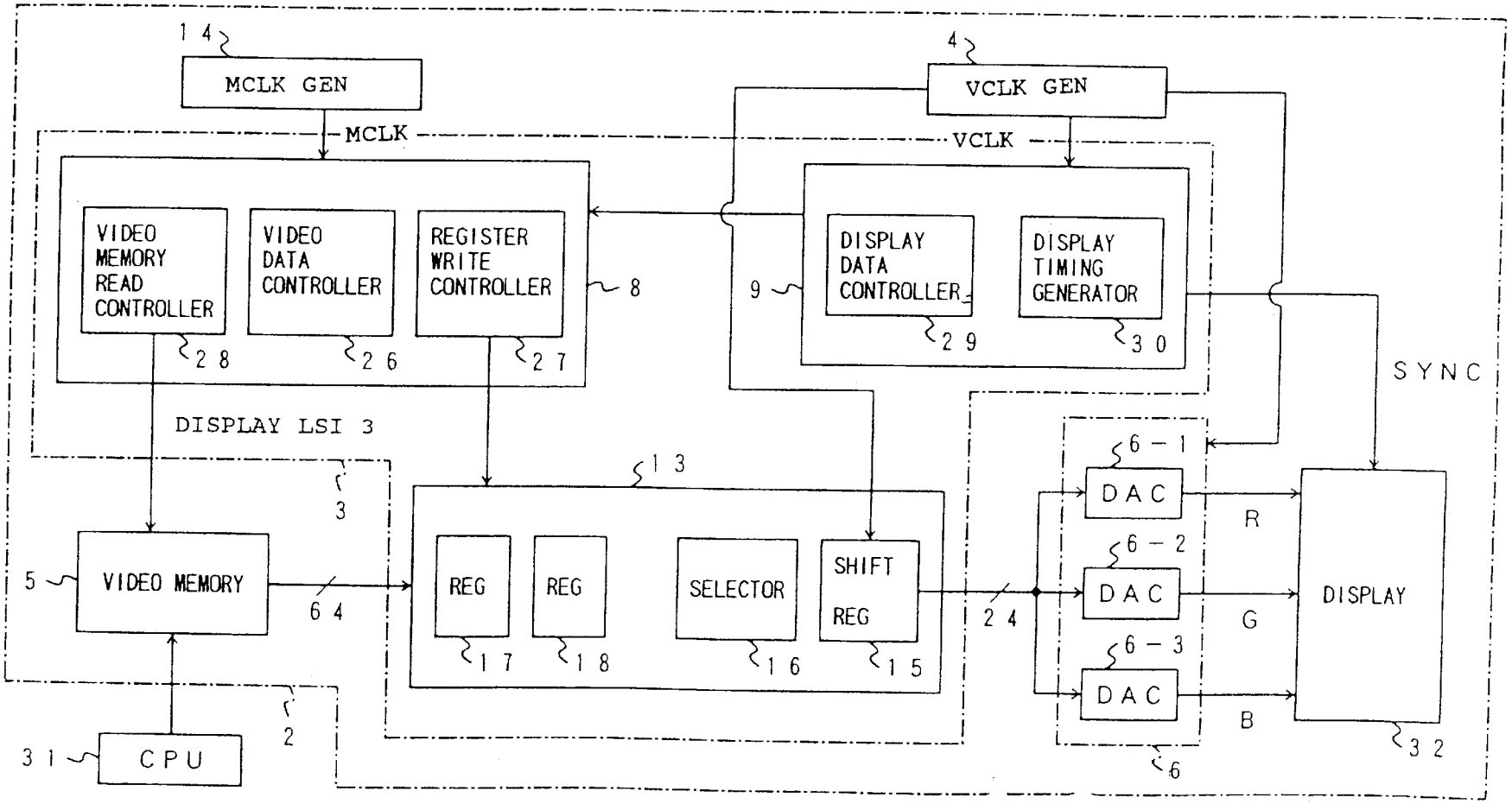
FIG. 3 is a system block diagram generally showing a first embodiment of a multicolor image display unit according to the present invention.

FIG. 3 generally shows the construction of this first embodiment. First, a description will be given of the general construction of the multicolor image display unit.

As shown in FIG. 3, the multicolor image display unit generally includes a video clock generator 4, a memory clock generator 14, a video memory 5, the display LSI 3, a DAC part 6, and a display 32. A central processing unit (CPU) 31 is coupled to the video memory 5.

The display LSI 3 includes a video memory controller 8, a display controller 9, and a display data processing part 13. This display data processing part 13 includes a shift register 15, a selector 16, and register parts 17 and 18. The register part 17 is made up of registers 19, 20 and 21, and the register part 18 is made up of registers 22, 23 and 24.

The video memory controller 8 includes a video data controller 26, a register write controller 27 and a video memory read controller 28. The display controller 9 includes a display data controller 29 and a display timing generator 30. The DAC part 6 includes DACs 6-1, 6-2 and 6-3.

The display LSI 3 includes the video memory controller 8, the display controller 9, and the display data processing part 13. This display LSI 3 is formed as a semiconductor chip, and carries out operations such as controlling transfer of image data from the video memory 5 to the DAC part 6 and generating a synchronizing signal SYNC with respect to the display 32.

The video clock generator 4 generates a video clock signal VCLK, and supplies this video clock signal VCLK to the display controller 9, the shift register 15 and the DAC part 6. This video clock signal VCLK is the same as that of the conceivable display unit shown in FIG. 1.

The memory clock generator 14 generates a memory clock signal MCLK and supplies this memory clock signal MCLK to the video memory controller 8. This memory clock signal MCLK has a frequency different from that of the video clock signal VCLK, and is asynchronous to the video clock signal VCLK.

The video memory 5 stores image data to be displayed. The image data stored in the video memory 5 are transferred from the CPU 31.

The DAC part 6 is made up of the DACs 6-1, 6-2 and 6-3 which are respectively provided in correspondence with the red (R), green (G) and blue (B) input terminals of the display 32. Each of the DACs 6-1, 6-2 and 6-3 convert the digital image data transferred from the display data processing part 13 into analog data. The analog data are transferred to the display 32 and displayed thereon. In this case, the DAC part 6 receives the 24-bit digital image data from the display data processing part 13, and 8 bits of the 24-bit digital data are supplied to each of the DACs 6-1, 6-2 and 6-3.

The video memory controller 8 controls the reading of the image data from the video memory 5 and data transfer control based on a data request signal DRS from the display controller 9. The control operations of the video memory controller 8 are carried out based on the memory clock signal MCLK from the memory clock generator 14.

The display controller 9 carries out various kinds of display control operations, and also generates the synchronizing signal SYNC which is supplied to the display 32. The control operations of the display controller 9 are carried out based on the video clock signal VCLK from the video clock generator 4. When making the data transfer from the video memory 5 under the control of the display controller 9, the display controller 9 carries out the control by supplying the data request signal DRS to the video memory controller 8 and supplying the data selection signal DSS to the selector 16.

The register part 17 is made up of three registers 19, 20 and 21 which are connected in series. The register 17 has the function of temporarily storing the image data, and the function of making a data conversion from 64 bits to 192 bits.

The register part 18 is made up of three registers 22, 34 and 24 which are connected in series. The register 18 has the function of temporarily storing the image data, and the function of making a data conversion from 64 bits to 192 bits.

The shift register 15 makes a data conversion from 192 bits to 24 bits by storing and reading the image data output from the selector 16.

The selector 16 alternately switches and outputs the output of the register part 17 and the output of the register part 18 in response to the data selection signal DSS from the display data controller 29 within the display controller 9.

The video memory read controller 28 within the video memory controller 8 outputs the read clock signal and the memory address to the video memory 5 in response to an instruction from the video data controller 26 within the video memory controller 8, so as to control the data read from the video memory 5.

The video data controller 26 within the video memory controller 8 controls the data read from the memory 5 in response to the data request signal DRS from the display data controller 29 within the display controller 9.

The register write controller 27 within the video memory controller 8 forms the write signal "0" and the write signal "1" in response to an instruction from the video data controller 26 within the video memory controller 8. The register write controller 27 alternately outputs the write signal "0" and the write signal "1" to the register parts 17 and 18 within the display data processing part 13, so as to control the writing of the image data to the register parts 17 and 18.

The display data controller 29 within the display controller 9 carries out various kinds of control operations when transferring the display data, by outputting various signals in response to a timing signal from the display timing generator 30 within the display controller 9. The various signals output from the display data controller 29 include the data request signal DRS, the data selection signal DSS and the load signal LD.

The display timing generator 30 within the display controller 9 forms and outputs the timing signals such as the synchronizing signal SYNC when transferring the display data and displaying the display data.

Figure 4:
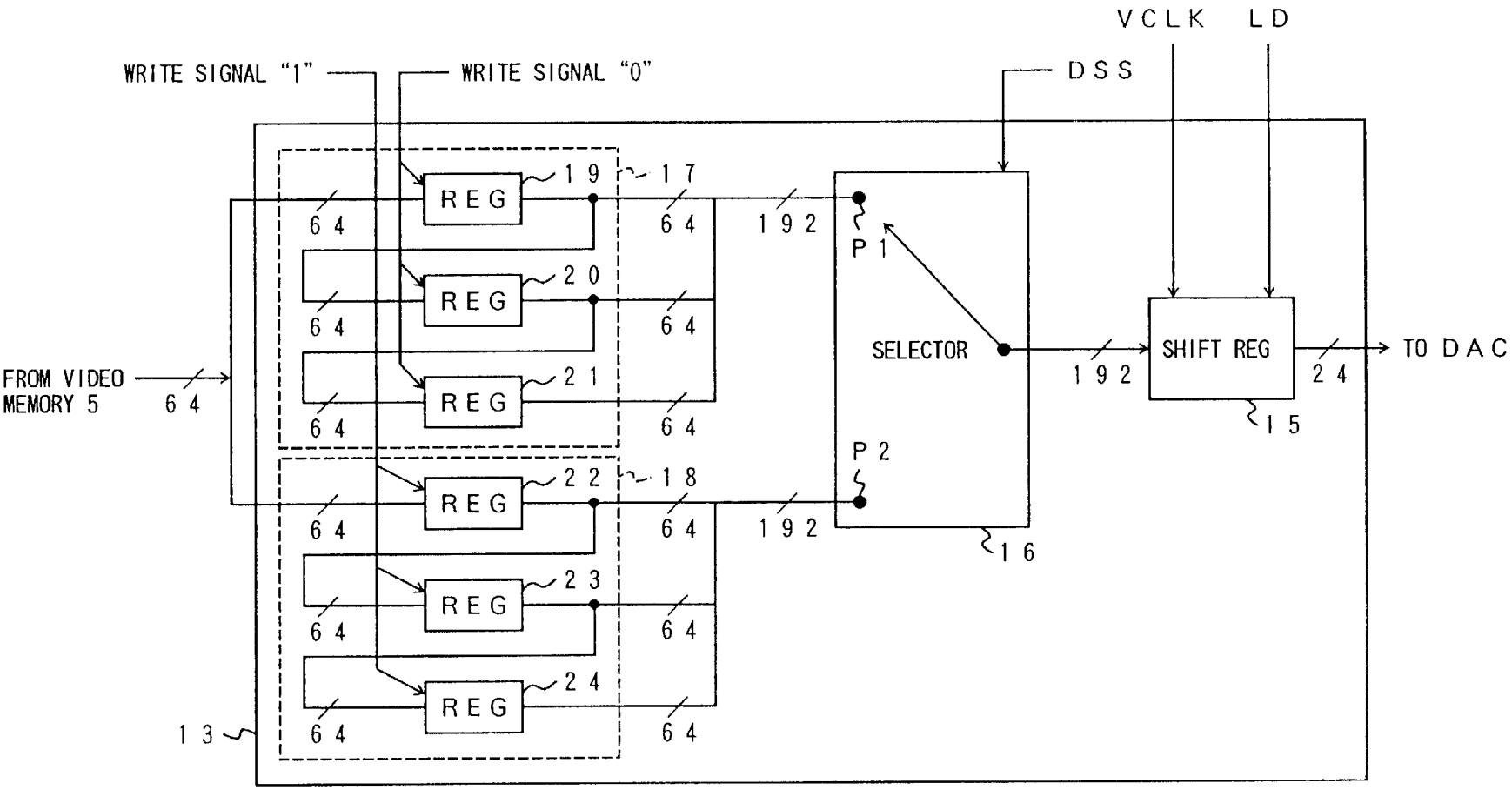
FIG. 4 is a system block diagram showing an important part of the first embodiment.

FIG. 4 shows the construction of the display data processing part 13, and a more detailed description will be given of the display data processing part 13 with reference to FIG. 4.

As shown in FIG. 4, the display data processing part 13 includes the register parts 17 and 18, the shift register 15 and the selector 16. The register part 17 includes the three registers 19, 20 and 21 which are connected in series as shown, and the register part 18 includes the three registers 22, 23 and 24 which are connected in series as shown.

In this case, the registers 19 through 24 forming the register parts 17 and 18 all have the same capacity, namely, 64 bits. In other words, the bus width at the input and output of each of the registers 19 through 24 is set to 64 bits, which is the same as the bus width at the output side of the video memory 5.

In the register part 17, the 64-bit input of the register 19 is connected to the 64-bit output of the video memory 5. The 64-bit output of the register 19 is connected to the 64-bit input of the register 20. In addition, the 64-bit output of the register 20 is connected to the 64-bit input of the register 21. The 64-bit outputs of each of the registers 19, 20 and 21 are connected in parallel to one 192-bit input terminal P1 of the selector 16, so as to make the data conversion from 64 bits to 192 bits.

The register part 17 writes the 64-bit data when the write signal "0" is received from the register write controller 27. In this case, the 64-bit image data are stored in only the register 19 in response to the first write signal "0". The image data in the register 19 are shifted to the register 20 and the next 64-bit image data transferred from the video memory 5 are stored in the register 19, in response to the second write signal "0". In this state, the image data are stored in both the registers 19 and 20.

Then, the image data in the register 20 are shifted to the register 21, the image data in the register 19 are shifted to the register 20, and the next image data transferred from the video memory 5 are stored in the register 19, in response to the third write signal "0". In this state, the image data are stored in all of the registers 19, 20 and 21.

Hence, the above described operation is repeated and the image data are successively shifted every time the write signal "0" is received.

In other words, the image data are stored in the register part 17 while shifting the image data in the registers 19, 20 and 21 and, at the same time, the 64-bit image data are converted into the 192-bit image data.

In the register part 18, the 64-bit input of the register 22 is connected to the 64-bit output of the video memory 5. The 64-bit output of the register 22 is connected to the 64-bit input of the register 23. In addition, the 64-bit output of the register 23 is connected to the 64-bit input of the register 24. The respective 64-bit outputs of the registers 22, 23 and 24 are connected in parallel to the other 192-bit input terminal P2 of the selector 16, so as to make the data conversion from 64 bits to 192 bits.

The register part 18 writes the 64-bit data when the write signal "1" is received from the register write controller 27. In this case, the 64-bit image data are stored in only the register 22 in response to the first write signal "1". The image data in the register 22 are shifted to the register 23 and the next 64-bit image data transferred from the video memory 5 are stored in the register 22, in response to the second write signal "1". In this state, the image data are stored in both the registers 22 and 23.

Then, the image data in the register 23 are shifted to the register 24, the image data in the register 22 are shifted to the register 23, and the next image data transferred from the video memory 5 are stored in the register 22, in response to the third write signal "1". In this state, the image data are stored in all of the registers 22, 23 and 24.

Hence, the above described operation is repeated and the image data are successively shifted every time the write signal "1" is received.

In other words, the image data are stored in the register part 18 while shifting the image data in the registers 22, 23 and 24 and, at the same time, the 64-bit image data are converted into the 192-bit image data.

In addition, the selector 16 switches between the 192-bit image data from the register part 17 and the 192-bit image data from the register part 18 in response to the data selection signal DSS output from the display data controller 29. In this case, the selector 16 selectively outputs the 192-bit image data input to the input terminal P1 when switched to one position in response to the data selection signal DSS, and selectively outputs the 192-bit image data input to the input terminal P2 when switched to the other position in response to the data selection signal DSS.

The shift register 15 stores the 192-bit image data output from the selector 16 based on the load signal LD output from the display data controller 29 and the video clock signal VCLK output from the video clock generator 4.

The write signal "0" and the write signal "1" are alternately output from the register write controller 27, depending on the data request signal DRS. Accordingly, the register part 17 and the register part 18 alternately write and store the image data and carry out the data conversion based on these write signals "0" and "1".

Figure 5:
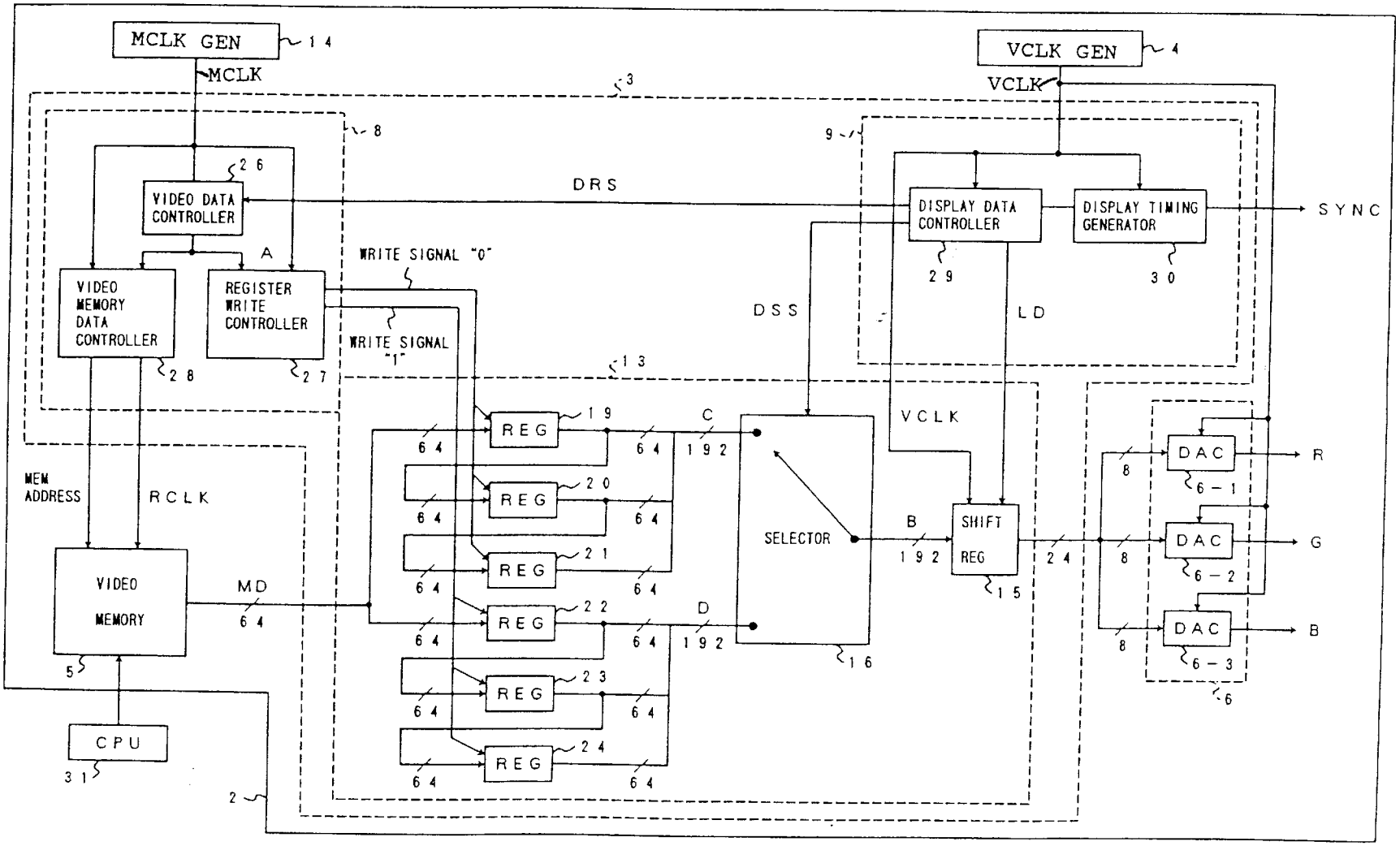
FIG. 5 is a system block diagram showing the construction of the first embodiment in more detail.

FIG. 5 shows the construction of the first embodiment in more detail. A more detailed description will now be given of the first embodiment by referring to FIG. 5.

The video clock signal VCLK generated from the video clock generator 4 is supplied to the display data controller 29, the display timing generator 30, the shift register 15 and the DAC part 6. In other words, each of these parts operate in synchronism with the video clock signal VCLK.

In the display controller 9, the display data controller 29 outputs the data request signal DRS with respect to the video data controller 26 so as to request the data transfer from the video memory 5. In addition, the display data controller 29 outputs the data selection signal DSS with respect to the selector 16, so as to control the switching of the selector 16. The display data controller 29 also outputs the load signal LD with respect to the shift register 15, so as to control the loading of data to the shift register 15. The display timing generator 30 outputs the timing signal to the display data controller 29, and generates the synchronizing signal SYNC which is supplied to the display 32.

The memory clock signal MCLK generated from the memory clock generator 14 is supplied to various parts of the video memory controller 8, including the video data controller 26, the video memory read controller 28 and the register write controller 27. In other words, these parts of the video memory controller 8 operate in synchronism with the memory clock signal MCLK.

The video memory controller 8 controls the data transfer from the video memory 5 in response to the data request signal DRS. In this case, the video data controller 26 outputs a control signal, that is, sends an instruction, with respect to the video memory read controller 28 in response to the data request signal DRS.

The video memory read controller 28 outputs the memory address and the read clock signal with respect to the video memory 5 in response to the control signal, so as to control the reading of the image data from the video memory 5. In this state, the image data are output from the video memory 5 and transferred to the display data processing part 13.

On the other hand, the register write controller 27 controls the data write to the register parts 17 and 18 based on the instruction from the video data controller 26. In this case, the register write controller 27 alternately generates the write signal "0" and the write signal "1" in response to the data request signal DRS, and alternately outputs these write signals "0" and "1" to the register parts 17 and 18.

The registers 19, 20 and 21 of the register part 17 write the image data while successively shifting the image data based on the write signal "0". The registers 22, 23 and 24 of the register part 18 write the image data while successively shifting the image data based on the write signal "1".

The selector 16 alternately switches the output of the register part 17 and the output of the register part 18 in response to the data selection signal DSS, and outputs one of the outputs of the register parts 17 and 18 at one time.

The shift register 15 loads the output image data of the selector 16 based on the load signal LD and the video clock signal VCLK described above.

The DAC part 6 converts the transferred digital image data into the analog image data in synchronism with the video clock signal VCLK, and the analog image data are supplied to the display 32.

For example, the numerical examples of elements of the multicolor image display unit described above are as follows.

1) Image data bit width: 24 bits=3 bytes

2) Clock signal frequency for image display: 80 MHz

3) Necessary image data transfer rate: 240 Mbytes/sec

4) Maximum read frequency of video memory: 30 MHz

5) Read frequency of video memory: 30 MHz

6) Necessary bus width of video memory: 64 bits=8 bytes

Next, a description will be given of the operation of this first embodiment, by referring to FIGS. 3 through 5.

As described above, the two register parts 17 and 18 are connected to the 64-bit bus of the video memory 5, and the data transfer frequency is reduced to ⅙ the original frequency. In other words, the data conversion from 64 bits to 192 bits is carried out.

Thereafter, the output of the register part 17 or 18 is selected by the selector 16, and the output of the selector 16 is supplied to the shift register 15 so as to obtain the 24-bit image data. In other words, the data conversion from 192 bits to 24 bits is carried out.

Next, the output of the shift register 15 is transferred to the DAC part 6 wherein each of the DACs 6-1, 6-2 and 6-3 convert the 8-bit data into analog data. The analog data from the DACs 6-1, 6-2 and 6-3 of the DAC part 6 are transferred to the display 32 as the R, G and B signals.

Finally, the display 32 displays the image described by the analog data from the DAC part 6, based on the synchronizing signal SYNC output from the display timing generator 30.

More particularly, when the data request signal DRS is output from the display data controller 29 to the video data controller 26, the video data controller 26 supplies the control signal (instruction). A shown in FIG. 5 to the register write controller 27 and the video memory read controller 28.

The video memory read controller 28 supplies the memory address and the read clock signal to the video memory 5 when the video memory read controller 28 receives this instruction from the video data controller 26, so as to control the reading of the image data from the video memory 5.

On the other hand, when the register write controller 27 receives this instruction from the video data controller 26, the register write controller 27 alternately supplies the write signal "0" and the write signal "1" to the register parts 17 and 18, so that the image data transferred from the video memory 5 are stored in the registers 17 and 18. Initially, the operation is carried out until the image data are stored in all of the registers 19 through 24 of the register parts 17 and 18.

Thereafter, the display data controller 29 outputs the data selection signal DSS with respect to the selector 16. When this data selection signal DSS is output, the selector 16 selects the output C of the register part 17 or the output D of the register part 18, and outputs one of these outputs C and D as the image data B shown in FIG. 5. The image data B output from the selector 16 are transferred to the shift register 15.

The image data B transferred from the selector 16 are once stored in the shift register 15 in response to the load signal LD from the display data controller 29. Then, the image data are read from the shift register 15 so as to carry out the data conversion from 192 bits to 24 bits, and the 24-bit image data are transferred to the DAC part 6.

Figure 6:
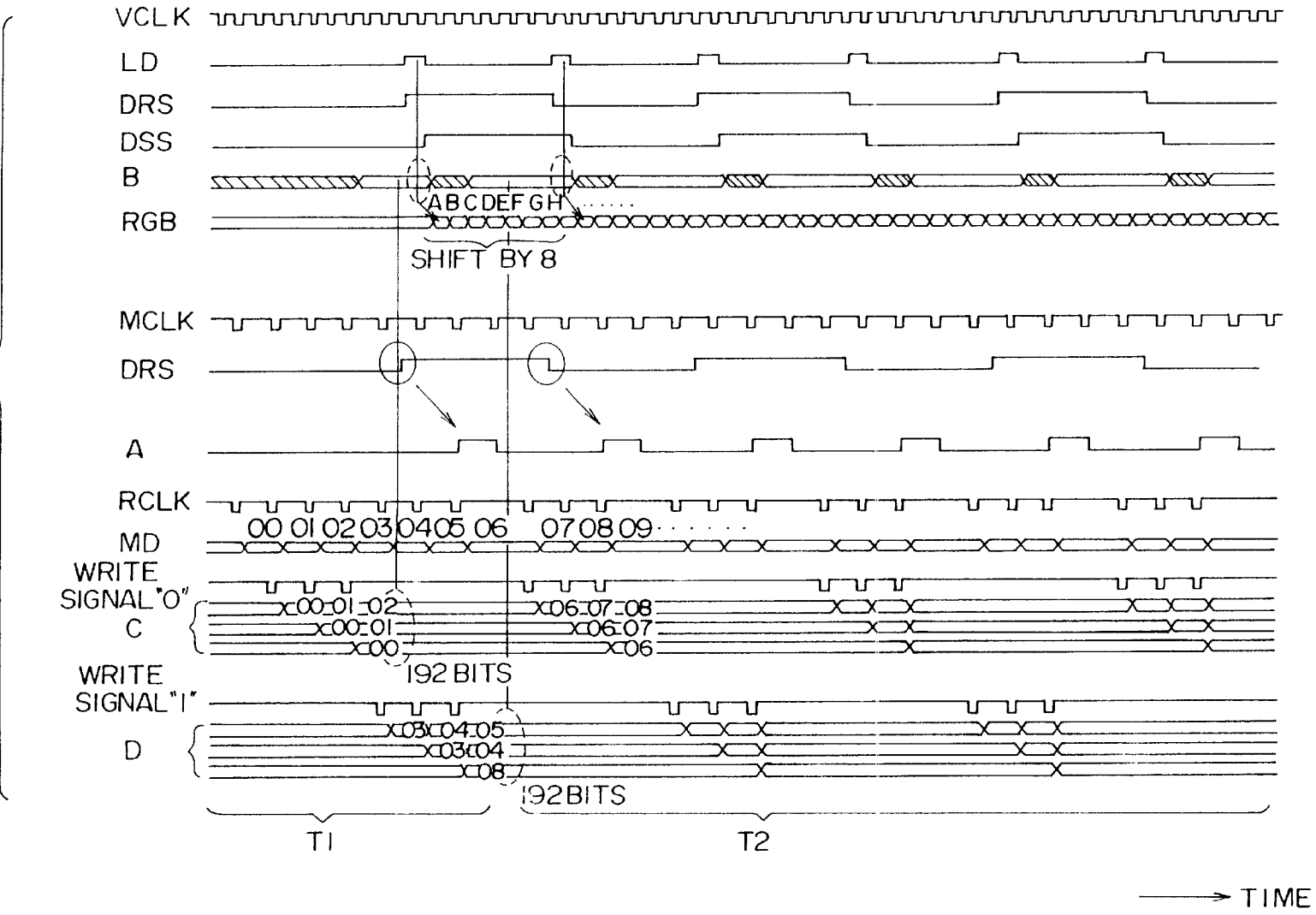
FIG. 6 is a timing chart for explaining the operation of the first embodiment.
Figure 7:
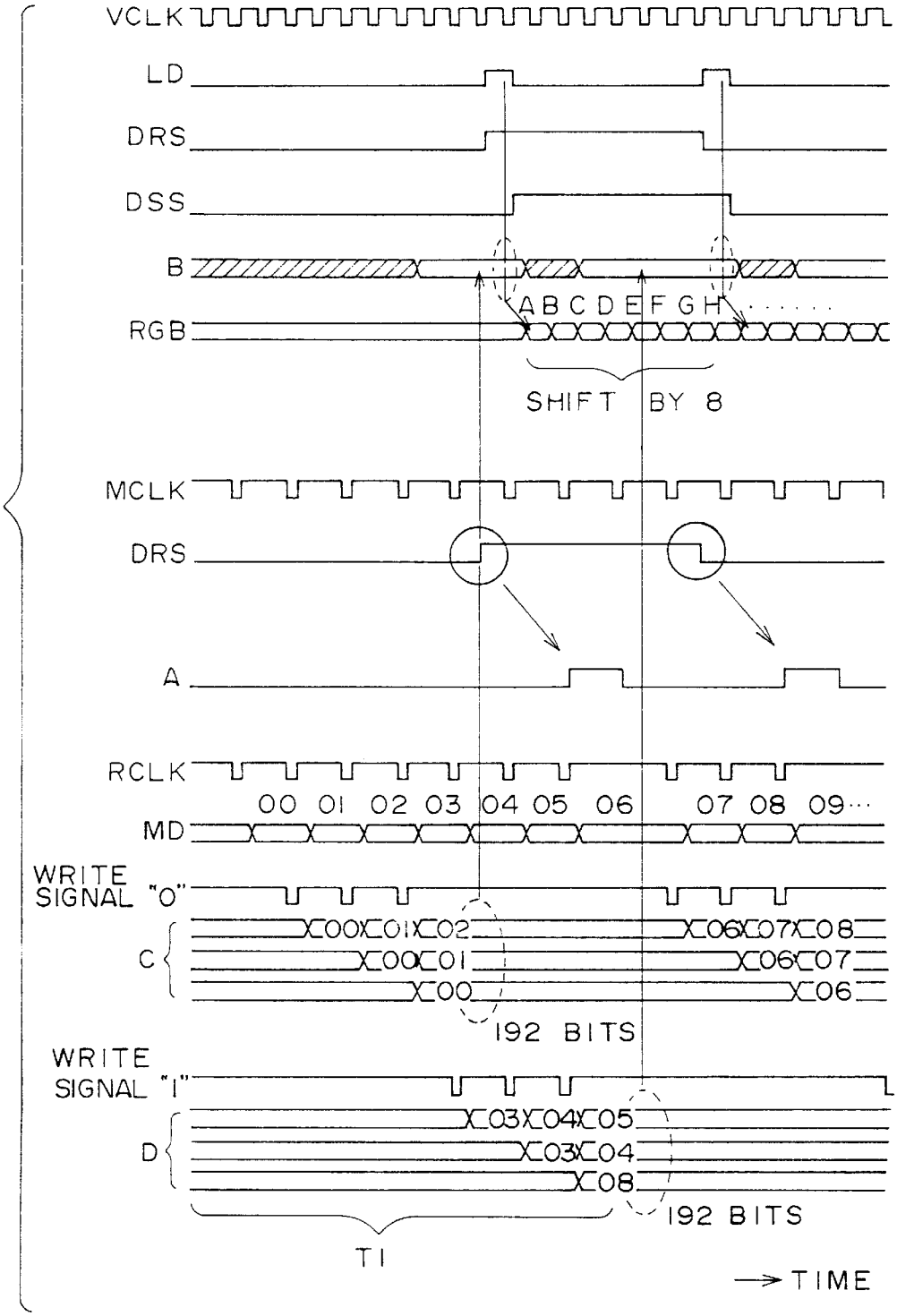
FIG. 7 is a timing chart showing a part of the timing chart shown in FIG. 6 on an enlarged scale.

The 24-bit image data are converted into the analog image data in units of 8 bits in the DACs 6-1, 6-2 and 6-3 of the DAC part 6, and transferred to the display 32. The display 32 displays the image described by the analog data from the DAC part 6. FIGS. 6 and 7 show timing charts for explaining the timings of the various signals during operation of this first embodiment.

FIG. 6 is a timing chart showing the various signals which occur during operation of this first embodiment, and FIG. 7 shows an important part of the timing chart of FIG. 6 on an enlarged scale. In FIGS. 6 and 7, a portion indicated by the hatching indicates that the data is not settled (or stabilized).

In addition, RGB denotes the analog data supplied to the display 32, MD denotes the image data read from the video memory 5, T1 denotes an interval in which the image data are stored into the register parts 17 and 18 until the image data are stored in all of the registers 19 through 24, and T2 denotes an interval in which the image data are read, every time the data request signal DRS is received.

In FIGS. 6 and 7, the video signal VCLK is generated from the video clock generator 4.

The load signal LD is output from the display data controller 29 and supplied to the shift register 15. The shift register 15 loads the image data transferred from the selector 16 based on this load signal LD and the video clock signal VCLK from the video clock generator 4.

The data request signal DRS is output from the display controller 29 and supplied to the video data controller 26. The video data controller 26 controls the reading of the image data from the video memory 5 in response to this data request signal DRS.

The data selection signal DSS is output from the display data controller 29 and supplied to the selector 16. The selector 16 alternately switches the output between the 192-bit output of the register part 17 and the 192-bit output of the register part 18 in response to this data selection signal DSS.

The 192-bit image data B are output from the selector 16. The 192-bit image data B are either the image data C subjected to the data conversion in the register part 17 or the image data D subjected to the data conversion in the register part 18. In this case, the selector 16 is alternately switched by the data selection signal DSS, so that the image data C and the image data D are alternately output from the selector 16 as the image data B.

The analog image data RGB are output from the DAC part 6 and supplied to the display 32. The analog image data RGB are transferred in units of 8 bits.

The memory clock signal MCLK is generated from the memory clock generator 14. The frequency of this memory clock signal MCLK is different from that of the video clock signal VCLK, and is asynchronous to the video clock signal VCLK.

The control signal A is output from the video data controller 26 and supplied to the register write controller 27. This control signal A is output depending on a transition of the data request signal DRS from the low level ("0") to the high level ("1") or vice versa.

The read clock signal RCLK is output from the video memory read controller 28 and supplied to the video memory 5 for the purpose of reading the image data from the video memory 6. This read clock signal RCLK is synchronized to the memory clock signal MCLK. The image data are read from the video memory 5 in synchronism with the read clock signal RCLK.

The memory data MD are the 64-bit image data read from the video memory 5 in synchronism with the read clock signal RCLK.

The write signal "0" is output from the register write controller 27 and supplied to the register part 17. The register part 17 writes and shifts the image data in response to the write signal "0".

The 192-bit image data C output from the register part 17 are formed by the 64-bit image data read out in parallel from the registers 19, 20 and 21 of the register part 17.

The write signal "1" is output from the register write controller 27 and supplied to the register part 18. The register part 18 writes and shifts the image data in response to the write signal "1".

The 192-bit image data D output from the register part 18 are formed by the 64-bit image data read out in parallel from the registers 22, 23 and 24 of the register part 18.

The register parts 17 and 18 carry out the data storage and data conversion described above, based on the write signals "0" and "1". Initially, the image data are stored until the image data are stored in all of the registers 19 through 24, as indicated by the interval T1. Thereafter, the image data are read and transferred from each of the register parts 17 and 18 every time the data request signal DRS is received, as indicated by the interval T2.

Of course, the number of registers forming each of the register parts 17 and 18 is not limited that of the first embodiment. For example, each of the register parts 17 and 18 may be formed of more than three registers or less than three registers. For example, the register part 17 may be formed by a single register having a capacity of 192 bits corresponding to the total capacity of the registers 19, 20 and 21, and the register part 18 may similarly be formed of a single register having a capacity of 192 bits corresponding to the total capacity of the registers 22, 23 and 24. In this case, the image data from the video memory 5 are successively shifted and stored in units of 64 bits with respect to each of the two registers respectively forming the register parts 17 and 18.

Figure 8:
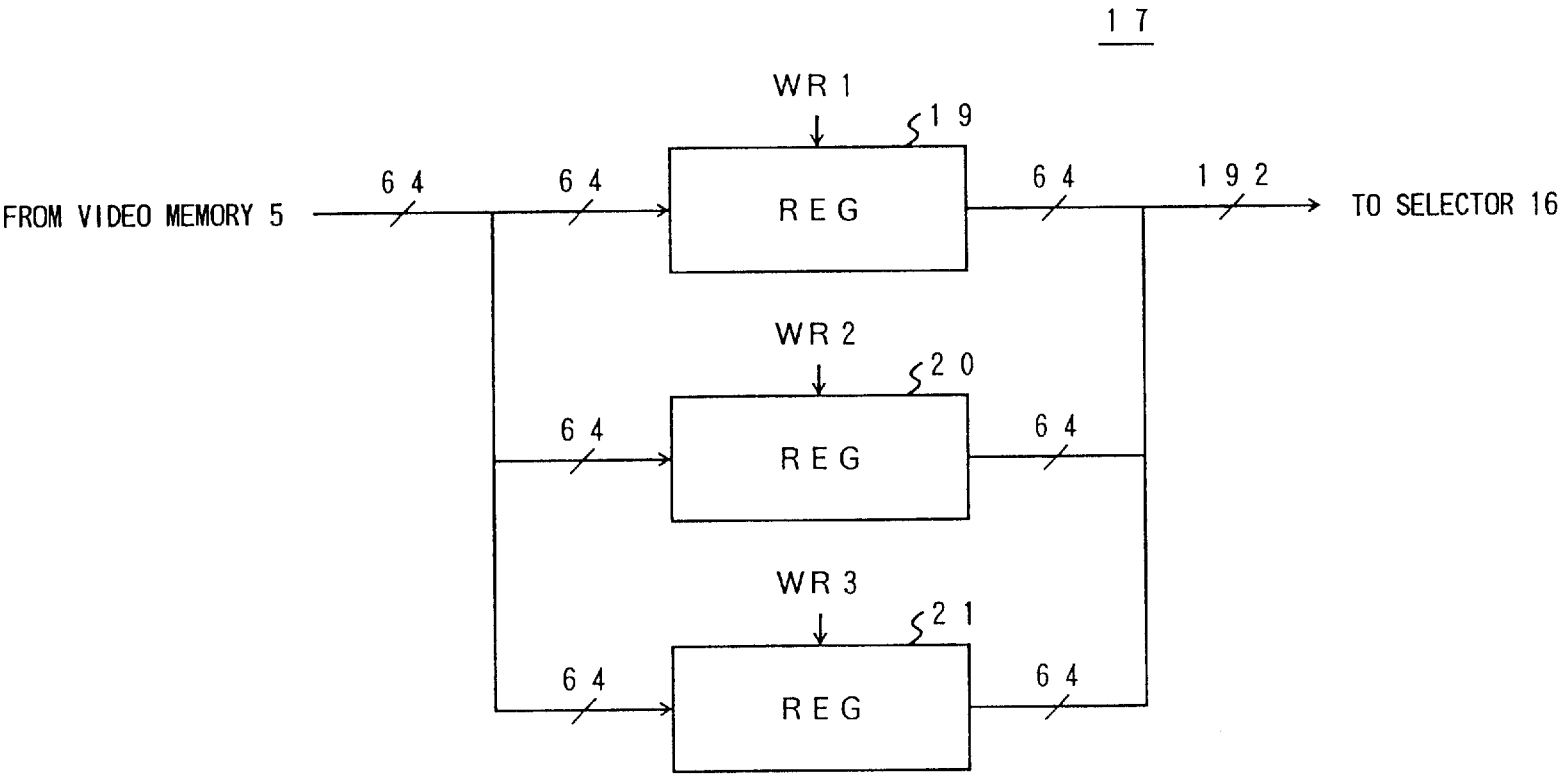
FIG. 8 is a system block diagram showing an important part of a second embodiment of the multicolor image display unit according to the present invention.

FIG. 8 shows an important part of a second embodiment of the multicolor image display unit according to the present invention. More particularly, FIG. 8 shows the construction of one register part 17 out of the two register parts 17 and 18.

In FIG. 8, the register part 17 is also formed by three registers 19, 20 and 21. However, the 64-bit bus at the output of the video memory 5 is connected in parallel to each of the registers 19, 20 and 21. Hence, in this embodiment, the register write controller 27 of the video memory controller 8 generates three kinds of write signals WR1, WR2 and WR3 with respect to the register part 17, so that the 64-bit image data from the video memory 5 are sequentially stored in the registers 19, 20 and 21 in response to these write signals WR1, WR2 and WR3. In other words, the first 64-bit image data are stored in the register 19 in response to the write signal WR1, the next 64-bit image data are stored in the register 20 in response to the write signal WR2, and the next 64-bit image data are stored in the register 21 in response to the write signal WR3. The register part 18 may be constructed similarly to the register part 17.

Furthermore, various kinds of memory means may be used in place of the register parts 17 and 18.

Of course, the bus widths at various parts of the multicolor image display unit are not limited to those of the above described embodiments.

In addition, the present invention is not only applicable to the multicolor image display unit, but is also similarly applicable to other display units, such as a monochrome image display unit having an extremely high resolution.

Moreover, the memory clock signal MCLK may of course be synchronized or asynchronous to the video clock signal VCLK.

Further, the present invention is not limited to these embodiments, but various variations and modifications may be made without departing from the scope of the present invention.

What is claimed is:

1. An image processing circuit comprising:

input terminals receiving image data as a first number of bits;

a memory, coupled to said input terminals, selectively storing the image data received at said input terminals and outputting the image data stored therein as a second number of bits, which is an integral multiple of the first number of bits, in response to a write signal which is synchronized to a memory clock signal having a first frequency; and a shift register, coupled to said memory, selectively, and in succession, storing the image data output from said memory and outputting the image data stored therein as a third number of bits in response to a video clock signal which has a second frequency, different from the first frequency of the memory clock signal, said third number of bits being less than said second number of bits.

2. The image processing circuit as claimed in claim 1, wherein said memory and said shift register are implemented in an integrated circuit chip.

3. The image processing circuit as claimed in claim 1, wherein said memory comprises a first memory and a second memory alternately storing and outputting the image data received at said input terminals as the second number of bits, in response to write signals which are synchronized to the memory clock signal.

4. The image processing circuit as claimed in claim 3, further comprising a selector, coupled to said first and second memories, alternately outputting the image data from said first memory and the image data from said second memory as said second number of bits in response to a data selection signal which is synchronized to the video clock signal.

5. The image processing circuit as claimed in claim 1, wherein said input terminals receive the image data read from a video memory in response to a read clock signal which is synchronized with the memory clock signal.

6. The image processing circuit as claimed in claim 1, wherein the first frequency of the memory clock signal is higher than the second frequency of the video clock signal.

7. The image processing circuit as claimed in claim 6, wherein the memory clock signal is asynchronous with respect to the video clock signal.

8. The image processing circuit as claimed in claim 1, wherein a relationship VF.VW<MF.MW exists, where VF denotes the second frequency of the video clock signal in MHz, VW denotes a bit width of said shift register equal to said third number of bits, MF denotes the first frequency of the memory clock signal in MHz, MW denotes a bit width of said memory equal to said second number of bits, MF.MW denotes a data transfer capability of said memory in Mbits/s, and VF.VW denotes a data transfer capability in Mbits/s that is necessary for displaying said image data.

9. A display unit, comprising:

a video memory storing image data and outputting the image data, stored therein, as a first number of bits;

a digital-to-analog converter converting the image data transferred from said video memory into analog image data which is output thereby;

an integrated circuit device controlling transfers of the image data from said video memory to said digital-to-analog converter;

a display displaying an image defined by the analog image data output by said digital-to-analog converter;

a memory clock generator generating and outputting a memory clock signal having first frequency and supplied to the video memory for controlling the output of the image data stored therein;

a video clock generator generating and outputting a video clock signal having a second frequency, different from the first frequency, used for controlling display of the image data; and the image data read from said video memory and output therefrom, as the first number or bits, being converted and temporarily stored, as a second number of bits which is an integral multiple of the first number of bits, under the control of said integrated circuit device and in synchronism with the memory clock signals, and said integrated circuit device converting the temporarily stored image data for transfer to a digital-to-analog converter as a third number of bits, less than the second number of bits, in synchronism with the video clock signal.

10. The display unit as claimed in claim 9, wherein the first frequency of the memory clock signal is higher than the second frequency of the video clock signal.

11. The display unit as claimed in claim 10, wherein the memory clock signal is asynchronous with respect to the video clock signal.

12. A display unit comprising:

a video memory storing image data and outputting the image data, stored therein, as a first number of bits;

a digital-to-analog converter converting the image data transferred from said video memory into analog image data which is output thereby;

an integrated circuit device controlling transfers of the image data from said video memory to said digital-to-analog converter;

a display displaying an image defined by the analog image data output by said digital-to-analog converter;

a memory clock generator generating and outputting a memory clock signal having a first frequency;

a video clock generator generating and outputting a video clock signal having a second frequency, different from the first frequency, used for controlling display of the image data;

the image data being read from said video memory and output therefrom, under the control of said integrated circuit device in synchronism with the memory clock signal; and said integrated circuit device further comprises:

a further memory receiving and storing the image data from said video memory as a second number of bits, which is an integral multiple of the first number of bits, in response to a write signal which is synchronized to the memory clock signal; and a shift register, coupled to said memory, successively storing and outputting the image data from said further memory as a third number of bits in response to the video clock signal, said third number of bits being less than said second number of bits.

13. The display unit as claimed in claim 12, wherein said further memory comprises a first memory and a second memory alternately storing and outputting the image data received at said input terminals as the second number of bits, in response to write signals which are synchronized to the memory clock signal.

14. The display unit as claimed in claim 13, wherein said integrated circuit device further comprises:

a selector, coupled to said first and second memories, alternately outputting the image data from said first memory and the image data from said second memory as said second number of bits in response to a data selection signal which is synchronized to the video clock signal.

15. The display unit as claimed in claim 12, wherein said integrated circuit device receives the image data read from said video memory in response to a read clock signal which is synchronized to the memory clock signal.

16. The display unit as claimed in claim 12, wherein the first frequency of the memory clock signal is higher than the second frequency of the video clock signal.

17. The display unit as claimed in claim 12, wherein a relationship VF.VW<MF.MW exists, where VF denotes the second frequency of the video clock signal in MHz, VW denotes a bit width of said shift register equal to said third number of bits, MF denotes the first frequency of the memory clock signal in MHz, MW denotes a bit width of said memory equal to said second number of bits, MF.MW denotes a data transfer capability of said memory in Mbits/s, and VF.VW denotes a data transfer capability in Mbits/s that is necessary for displaying said image data.

* * * * *

UNITED STATES PATENT AND TRADEMARK OFFICE

CERTIFICATE OF CORRECTION

PATENT NO. : 5,821,948
DATED : Oct. 13,1998
INVENTOR(S) : yasuhisa Kawamoto et al.

It is certified that error appears in the above-identified patent and that said Letters Patent is hereby corrected as shown below:

Col. 1, line 21, change "display LSD" to -- "display LSI"--.

Col. 4, line 12, change "(VCLK GEN)" to --("VCLK GEN")--;
line 13, change "(MCLK GEN)" to --("MCLK GEN")--.

Col. 11, line 50, change "6" to --5--.

Col. 14, line 8, change "signals" to --signal--.

Signed and Sealed this

Third Day of August, 1999

*Attest:*

*Attesting Officer*

Q. TODD DICKINSON

*Acting Commissioner of Patents and Trademarks*